United States Patent [19]

Ohtani et al.

[11] Patent Number: 4,922,230

[45] Date of Patent: May 1, 1990

[54] FIRE DISCRIMINATING APPARATUS

[75] Inventors: Shigeru Ohtani, Hiratsuka; Yukio Yamauchi, Atsugi, both of Japan

[73] Assignee: Hochiki Corporation, Tokyo, Japan

[21] Appl. No.: 236,503

[22] Filed: Aug. 25, 1988

[30] Foreign Application Priority Data

Aug. 26, 1987 [JP] Japan ..... 62-211740

[51] Int. Cl.[5] ..... G08B 17/00

[52] U.S. Cl. ..... 340/577; 340/501; 340/557; 340/589

[58] Field of Search ..... 340/577, 588, 589, 587, 340/584, 501, 511

[56] References Cited

U.S. PATENT DOCUMENTS

| | | | |
|---|---|---|---|
| 3,781,837 | 12/1973 | Anderson et al. | 340/587 X |
| 4,388,616 | 6/1983 | Machida | 340/501 X |
| 4,644,331 | 2/1987 | Matsushita et al. | 340/588 X |
| 4,749,986 | 6/1988 | Otani et al. | 340/587 |

FOREIGN PATENT DOCUMENTS

| | | | |
|---|---|---|---|
| 2190777 | 11/1987 | United Kingdom | 340/577 |

*Primary Examiner*—Reinhard J. Eisenzopf

*Assistant Examiner*—Robert W. Mueller

*Attorney, Agent, or Firm*—Michael N. Meller

[57] ABSTRACT

A fire discriminating apparatus for determining whether there is the outbreak of fire in an area under surveillance in accordance with the temperature difference between a temperature detection value of the area and a reference temperature. The apparatus includes a temperature sensor for detecting an ambient temperature; sampling means for sampling the detected temperature of the temperature sensor at a given period, temperature difference detecting means for computing a temperature difference between the detected temperature and a reference temperature each time the detected temperature is sampled by the sampling means, fire discriminating means whereby when the temperature difference is greater than a predetermined threshold value the outbreak of a fire is determined and an alarm command signal is generated, and reference temperature correcting means whereby a correction value obtained by multiplying the temperature difference obtained upon each sampling by a given factor smaller than 1 is added to the reference temperature to correct the reference temperature for the detection of temperature difference during the next sampling.

4 Claims, 8 Drawing Sheets

FIRE DISCRIMINATING APPARATUS

BACKGROUND OF THE INVENTION

1. Field of the Invention

The present invention relates to a fire discriminating apparatus so designed that the breaking out of a fire in an area under surveillance is discriminated on the basis of the temperature difference between a temperature detection value of the area and a reference temperature.

2. Description of the Prior Art

Apparatus heretofore known in the art to determine the braking out of a fire in accordance with the temperature difference between a reference temperature and a detected temperature include a so-called differential-type heat sensing apparatus having a diaphragm arranged in an air chamber.

In other words, the differential-type heat sensing apparatus is designed so that the air chamber is divided into a reference chamber sealed by the diaphragm and a detecting chamber communicated with the outside air through an orifice whereby when exposed to the heat due to a fire, the air in the detecting chamber is caused by thermal expansion to leak to the outside through the orifice and switch contacts are closed by a deformation of the diaphragm due to the pressure difference produced between the detecting chamber and the reference chamber. Then, this differential-type heat sensing apparatus is required to satisfy both of two functions, that is, on the one hand to give an alarm in less than 4.5 minutes against, for example, a temperature rise rate of 15 deg/-min centigrade and on the other hand to give no alarm before the expiration of 15 minutes against, for example, a temperature rise rate of 3 deg/min centigrade.

On the other hand, in place of the above-mentioned mechanical type differential heat sensor, there has recently been proposed a heat sensing apparatus including a reference temperature sensor for reference temperature detecting purposes and another fire temperature sensor for detecting the actual temperature of an area under surveillance so as to detect a fire in accordance with the difference between the two detected temperatures. In other words, with this heat sensing apparatus, the reference temperature sensor is mounted within the sensing apparatus where it is not easily subjected to the effect of the temperature rise due to a fire, whereas the fire temperature sensor is mounted on a heat sensitive plate exposed to the outside of the sensing apparatus. As a result, when the ambient temperature rises due to a fire, the detected temperature of the reference temperature sensor rises slowly and the detected temperature of the fire temperature sensor rises in response to the actual temperature in the area under surveillance, thereby increasing the temperature difference between the two with the passage of time. This sensing apparatus generates a fire detection signal when the temperature difference exceeds a given threshold value.

With the differential-type heat sensing apparatus which determines the breaking out of a fire from the difference between the temperatures detected by the reference and fire temprature sensors, however, the variation characteristic of a reference temperature with respect to the variation of a fire temperature is determined by the heat conduction condition of the mouting mechanism of the reference temperature sensor so that the setting of this heat conduction condition must be effected by varying the mechanical conditions of the component parts and therefore it is difficult to accurately uniformly set a heat conduction condition for individual sensing apparatus. Thus, the fire detection characteristic varies among different sensing apparatus with the result that while the previously mentioned functions, i.e., the function of giving an alarm in less than 4.5 minutes against a temperature rise rate of 15 deg/min centigrade and the function of giving no alarm before the expiration of 15 minutes against a temperature rise rate of 3 deg/min centigrade are nearly satisfied, it is difficult to realize the desire that each of different sensing apparatus is accurately provided with the optimum fire discriminating characteristic which permits the early and accurate detection of a fire from the temperature difference between a fire temperature and a reference temperature.

SUMMARY OF THE INVENTION

The present invention has been made in view of the foregoing deficiencies in the prior art, and it is the primary object of the invention to provide a fire discriminating apparatus which is capable of instantaneously determine the outbreak of a fire by rapidly and accurately grasping any unusual temperature rise from the temperature difference between a fire temperature and a reference temperature and capable of easily and accurately effecting the setting of a fire detecting characteristic through the setting of electrical conditions.

To accomplish the above object, in accordance with the invention there is thus provided a fire discriminating apparatus including a temperature sensor for detecting the temperature of an area under surveillance to generate a detected temperature output signal proportional thereto; sampling means for intermittently sampling the detected temperature data detected by the temperature sensor at a given period, e.g., 5 second period; temperature difference detecting means whereby each time the detected temperature data is sampled by the sampling means an output corresponding to the temperature difference between the detected temperature resulting from the sampling and a predetermined reference temperature is generated; fire discriminating means for determining the breaking out of a fire in response to the temperature difference exceeding a predetermined threshold value to produce an alarm command signal; and reference temperature correcting means for producing a correction value by multiplying the value of the temperature difference resulting from each sampling by a given factor smaller than 1 to add the correction value to the reference temperature to correct it for the detection of a temperature difference during the next sampling.

As regards the reference temperature, the temperature of an area under surveillance detected by the temperature sensor during the initialization of the apparatus may be used as such as its set value.

Further, in accordance with a preferred form of the invention, temperature comparing means is additionally provided which produces another alarm command signal when the detected temperature detected by the temperature sensor reaches a predetermined upper limit temperature.

Further, in accordance with another preferred form the of the invention, maximum value limiting means for establishing an upper limit to the rate of rise of the sampled detected temperature and means for computing the moving average value of the sampled detected temperatures passed through the maximum value limiting means over a plurality of sampling periods are additionally provided between the sampling means and the temperature difference detecting means whereby the temperature difference detecting means generates an output corresponding to the temperature difference between the moving average value of the detected temperatures and the reference temperature in responses to each sampling.

In accordance with the fire discriminating apparatus of the invention constructed as described above, when the detected temperature by the temperature sensor rises linearly, for example, a reference temperature set by initially inputting the detected temperature is increased by the addition of a correction value computed in accordance with the then current detected temperature upon each sampling and the temperature difference between it and the detected temperature is gradually increased with time. Thus, after the expiration of a certain time, the reference temperature has a characteristic such that it rises with the same slope with the detected temperature.

Then, up to the time that the reference temperature starts rising with the same slope as the detected temperature, the temperature difference characteristic is such that the temperature difference is increased more greatly with increase in the rate of rise of the detected temperature (the slope is large) and the increase in the temperature difference is decreased with decrease in the rate of rise of the detected temperature (the slope is small).

In accordance with the invention, presupposing these characteristics of the detected temperature and the reference temperature, the temperature difference between the two is detected and compared with a given threshold value to determine the breaking out of a fire. The variation with time of the temperature difference between detected temperature and the reference temperature is such that while the temperature difference increases in an exponential functional manner at the beginning, at the expiration of a certain time the temperature difference converges to a constant value and this converged value increases with increase in the rate of rise in the detected temperature and decreases with decrease in the rate of rise.

As a result, by setting a value exceeding the said converged value for the temperature difference due to the ordinarily predicable temperature rise as a threshold value for the discrimination of a fire, it is possible to accurately detect a fire. In this case, in order to effect the determination of a fire as early as possible, by setting the threshold value to a value slightly exceeding the converged value for the temperature difference due to the ordinary temperature rise, it is possible to effect the determination of a fire at such early stage which has been difficult with the conventional differential-type.

In addition, any desired fire detecting sensitivity can be selected as desired by varying the setting of the threshold value for the temperature difference.

It will thus be seen that in accordance with the present invention, by virtue of the fact that the detection signal of a temperature sensor is sampled at a given period and a reference temperature is corrected in accordance with the difference between the detected temperature and the reference temperature thereby determining the breaking out of a fire when the difference between the detected temperature and the corrected reference temperature exceeds a predetermined threshold value, when any unusual temperature rise due to a fire is detected, it is promptly determined that there is the breaking out of a fire to minimize the dangers due to the fire.

The above and other objects as well as advantageous features of the invention will become more clear from the following description taken in conjunction with the drawings.

DESCRIPTION OF THE PREFERRED EMBODIMENTS

It is to be noted that in the following description and the accompanying drawings the terms "deg", "deg/-min", etc., are used as the units relating to temperature to represent the deviations for purposes of simplicity and all of them are values representing degrees centigrade.

Figure 1:
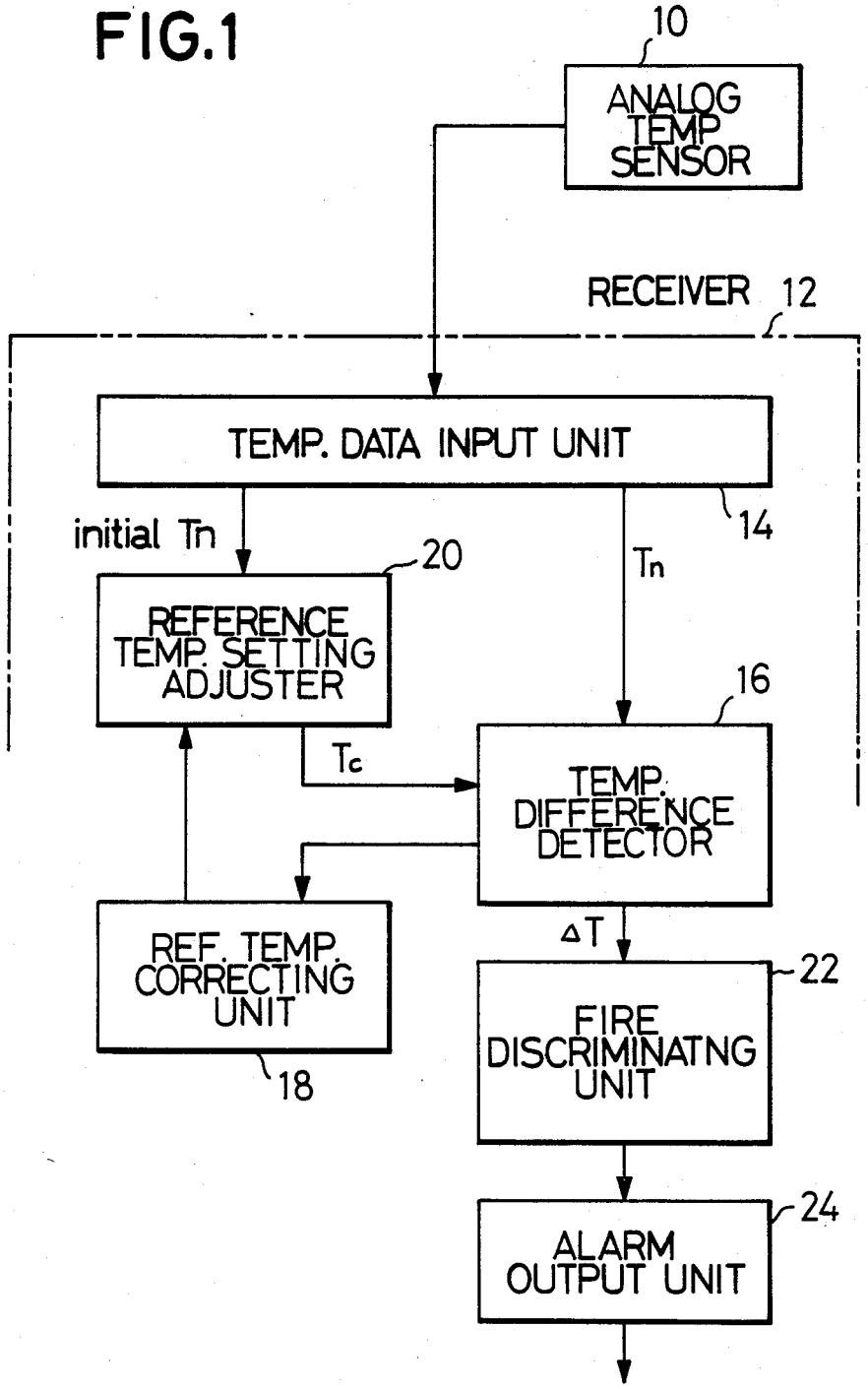
FIG. 1 is a block diagram showing the construction of an embodiment of the present invention.

Referring now to FIG. 1, numeral 10 designates an analog temperature sensor mounted for example on the ceiling or the like of a room in an area under surveillance to generate an analog detection signal corresponding to the ambient temperature. Numeral 12 designates a receiver installed for example in a central control room and connected to the analog temperature sensor 10 by a signal line.

The detection signal from the analog temperature sensor 10 is applied to a temperature data input 14 provided in the receiver 12. The temperature data input unit 14 samples the detection signal from the analog temperature sensor 10 at a given period, e.g., 5 second period to convert and output it as digital temperature data.

The temperature data sampled and converted to the digital data by the temperature data input unit 14 is applied to a temperature difference detector 16 so that each time the sampling is effected, the temperature difference detector 16 detects the temperature difference ΔT between the then current detected temperature Tn and a reference temperature Tc set by a reference temperature setting adjuster 20 which will be explained later. The reference temperature Tc used for the detection of the temperature difference ΔT in the temperature difference detector 16, is produced by a reference temperature correcting unit 18 and the reference temperature setting adjuster 20 and the two form a reference temperature computer.

In the initialization mode of the apparatus, the detected temperature Tn from the temperature data input unit 14 is itself set as the reference temperature Tc in the reference temperature setting adjuster 20. The reference temperature correcting unit 18 computes a correction value Ta from the following equation each time the temperature difference ΔT between the detected temperature Tn and the reference temperature Tc is obtained in the temperature difference detector 16 at the sampling period.

$$Ta=(Tn-Tc)*k \quad (1)$$

where

Tn is the current detected temperature

Tc is the current reference temperature k is a factor smaller than 1

Also, each time this correction value is obtained, the reference temperature correcting unit 18 adds the correction value to the reference temperature Tc set in the reference temperature setting adjuster 20 and the resulting updated value $Tc=Tc+Ta$ is set anew as a reference temperature for the computation is the temperature difference detector 16 at the time of the next sampling. What is meant by this correcting operation is that a reference temperature correction value Ta is computed by the multiplication of the temperature difference ΔT between the detected temperature Tn and the reference temperature Tc obtained by the temperature difference detector 16 by the predetermined factor k smaller than 1, e.g., k=0.03 and the correction value Ta is added to the original reference temperature Tc, thereby producing a new reference temperature. Therefore, where in the initialization mode the detected temperature Tn from the temperature data input unit 14 is itself set as the reference temperature Tc in the reference temperature setting adjuster 20, if there is no temperature rise in the area under surveillance, Tn=Tc in equation (1) and therefore the correction value Ta=0. If the temperature rises in the area under surveillance, the correction value Ta is increased with the passage of time and the value of the reference temperature is also increased correspondingly. This rate of increase can be arbitrarily selected by suitably setting the factor k.

It is to be noted that the factor k for correction value is set to a value smaller than 1 in accordance with the set value of a threshold value Ts for a fire discriminating unit 22 which will be described later, the sampling period for detected temperature data, etc.

The detection output ΔT of the temperature difference detector 16 is applied to the fire discriminating unit 22 which in turn compares the predetermined threshold value Ts and the temperature difference ΔT, so that when the temperature difference ΔT is greater than the threshold value Ts, it is determined that there is the outbreak of a fire and an alarm command signal output is applied to an alarm output unit 24. When this occurs, the alarm output unit 24 performs the cooperative control of various disaster preventive devices, etc., in accordance with the issuance of a fire alarm and fire detection in the receiver 12.

Figure 2:
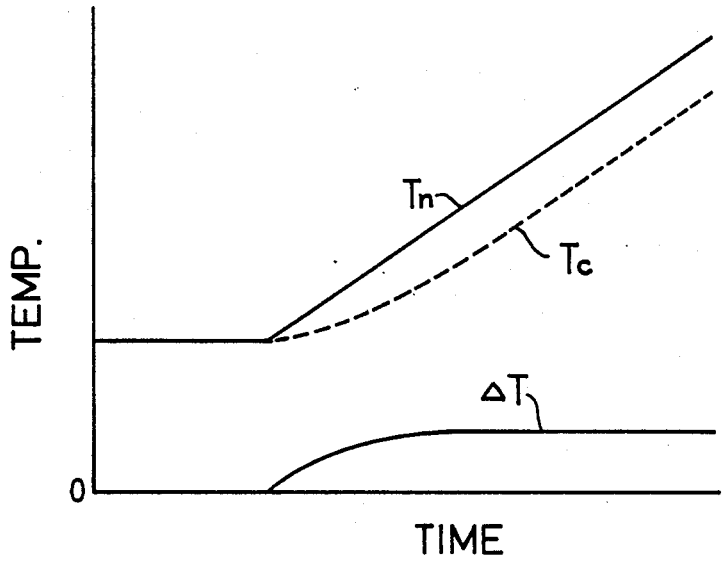
FIG. 2 is a graph showing variations with time of the reference temperature value Tc and the temperature different ΔT when the detected temperature Tn increases linearly.

FIG. 2 is a graph schematically showing variations with time of the reference temperature Tc and the temperature difference ΔT detected by the temperature difference detector 16 when the detected temperature of the analog temperature sensor 10 rises linearly. In the Figure, if the detected temperature Tn rises linearly with a given slope as shown by the solid line, the reference temperature Tc corrected by the addition of a correction value computed from equation (1) is initially increased so as to increase the temperature difference between it and the detected temperature Tn with the passage of time as shown by the broken line and after the lapse of a certain time the reference temperature Tc is increased with substantially the same slope as the detected temperature Tn while maintaining substantially the constant temperature difference between it and the detected temperature Tn. As a result, the temperature difference ΔT between the detected temperature Tn and the reference temperature Tc is initially increased in an exponential functional manner with the rise in the detected temperature Tn and after the expiration of a certain time it is substantially saturated so as to be considered as being converged to a constant value.

FIGS. 2A, 2B, 2C, 2D and 2E show the actual measured data of the temperature difference ΔT using the correction factor k as a parameter in cases of various temperature rise rates. In these graphs, the ordinate scale represents the temperature difference (deg) and the abscissa scale represents the time (min).

Figure 2A:
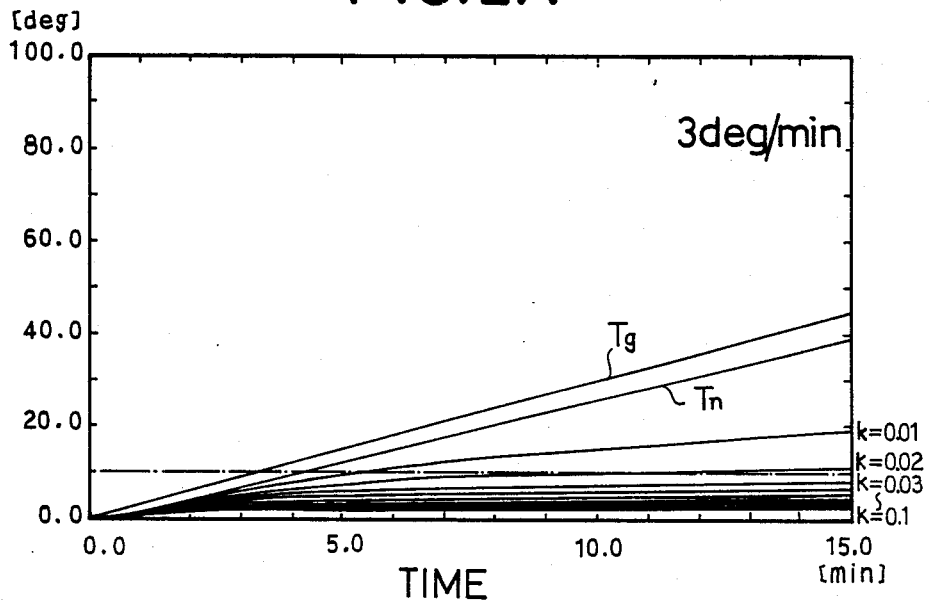
FIGS. 2A, 2B, 2C, 2D and 2E are graphs showing the actual measured data of the temperature difference ΔT with the correction factor k as a parameter in case of various temperature rise rates.
Figure 2B:
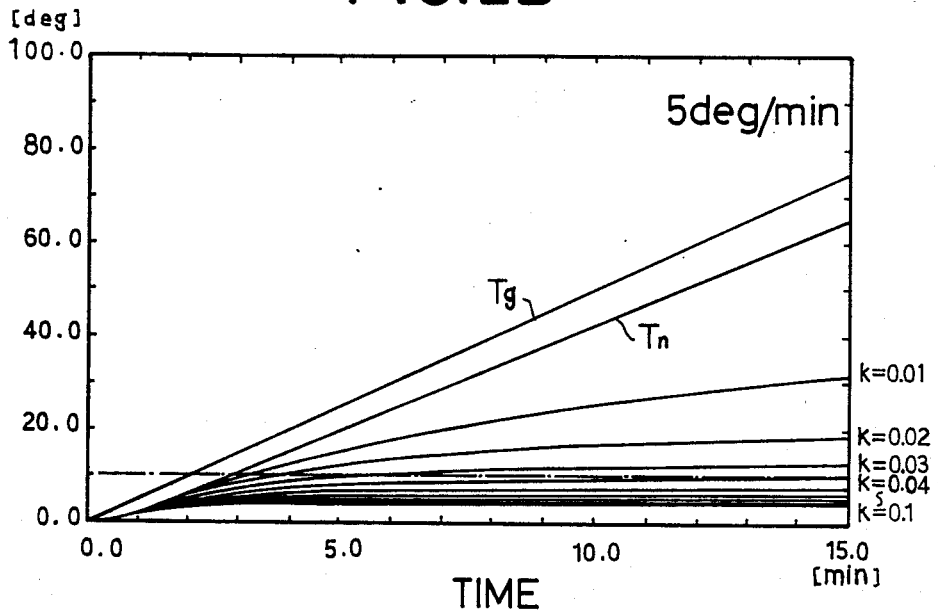
Figure 2C:
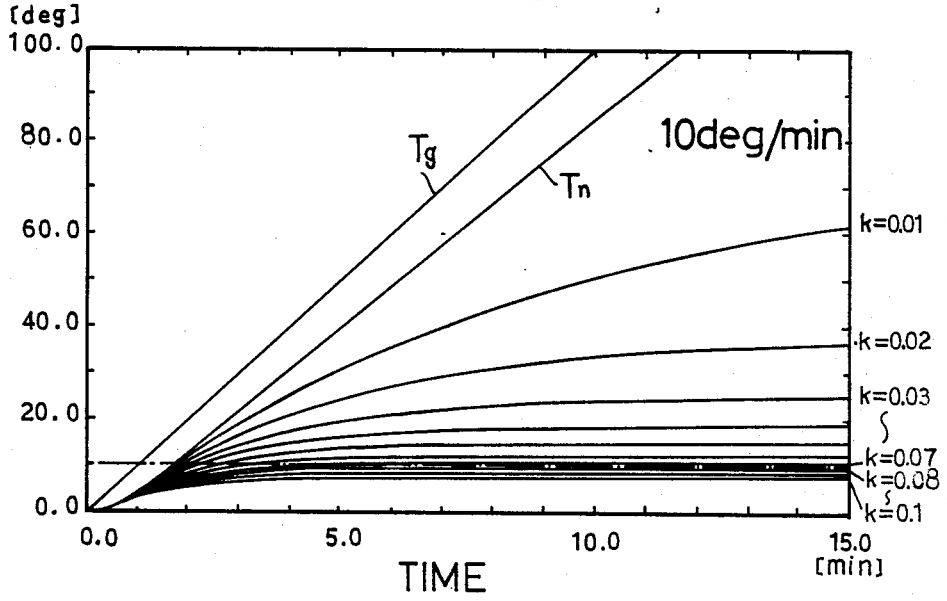
Figure 2D:
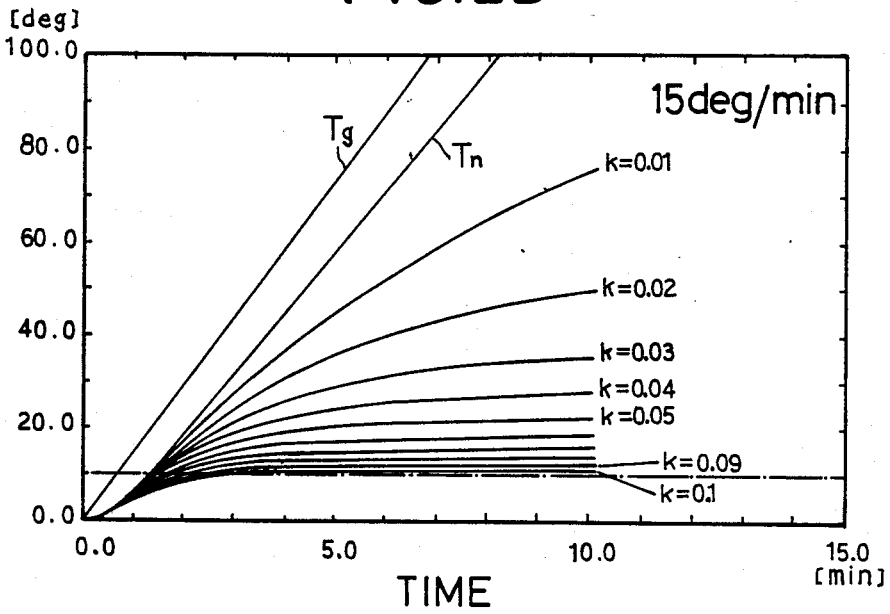
Figure 2E:
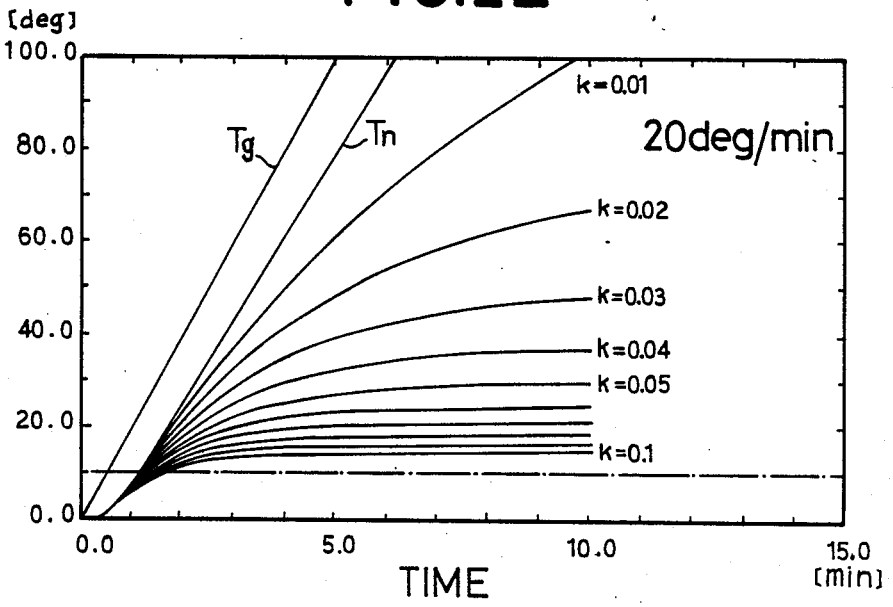

More specifically, FIG. 2A shows the case where the temperature rise is 3 deg/min centigrade, FIG. 2B the case of 5 deg/min, FIG. 2C the case of 10 deg/min, FIG. 2D the case of 15 deg/min, and FIG. 2E the case 20 deg/min. In the graphs of the Figures, the curve Tg represents the temperature of room where the temperature sensor is positioned, the curve Tn the detected temperature of the temperature sensor, and the remaining curves the temperature differences ΔT in cases where k=0.01 to 0.1, respectively.

Figure 3:
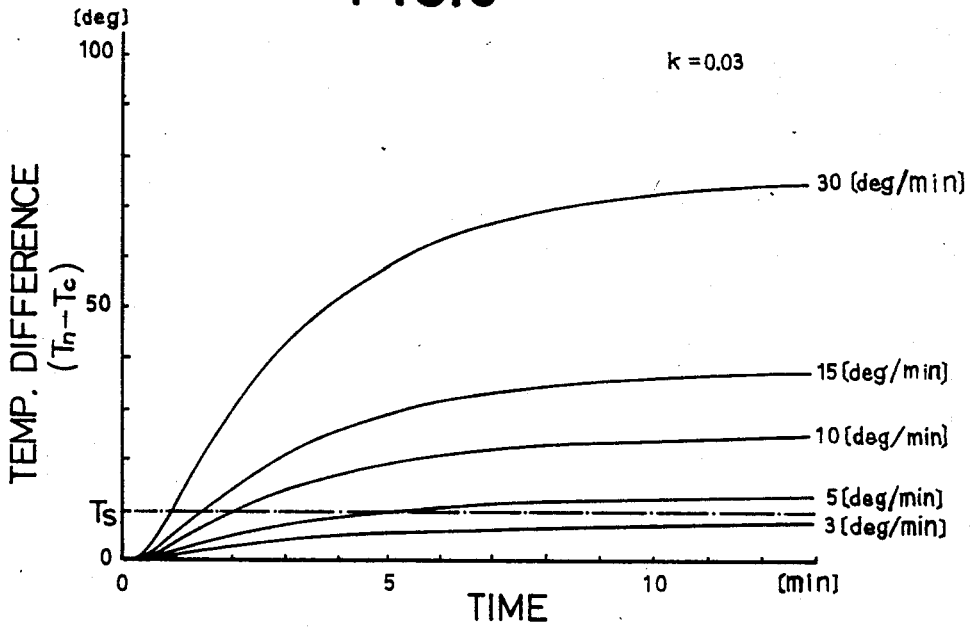
FIG. 3 is a graph showing variations of the temperature difference ΔT with time using the rise rate of the detected temperature Tn as a parameter.

FIG. 3 is a graph showing variations of the temperature difference ΔT between the detected temperature Tn and the reference temperature Tc with the rate of rise (the rate of change) of the detected temperature Tn as a parameter (where the factor k=0.03).

As will be seen from FIG. 3, the rise rate and converged value of the temperature difference increase with increase in the rise rate of the detected temperature, and the rise rate and covered value of the temperature difference are decreased with decrease in the rise rate of the detected temperature.

Thus, the desired threshold value Ts to be set in the fire discriminating unit 22 in the embodiment of FIG. 1 can be determined from the characteristics of the temperature difference ΔT shown in FIG. 3.

For instance, if the boundary value between the ordinarily predicable temperature rise rate and the temperature rise rate due to a fire is 3 deg/min centigrade in the case of FIG. 3, it is only necessary to set the threshold value to a value exceeding the converged value of the temperature difference when the rise rate is 3 deg/min, e.g., Ts=10 degrees (centigrade).

Of course, the threshold value Ts can be set closer to the converged value corresponding to the boundary value of 3 deg/min when it is desired to increase the detection sensitivity further, and the threshold value Ts can be set to a higher value when it is desired to decrease the detection sensitivity.

Figure 4:
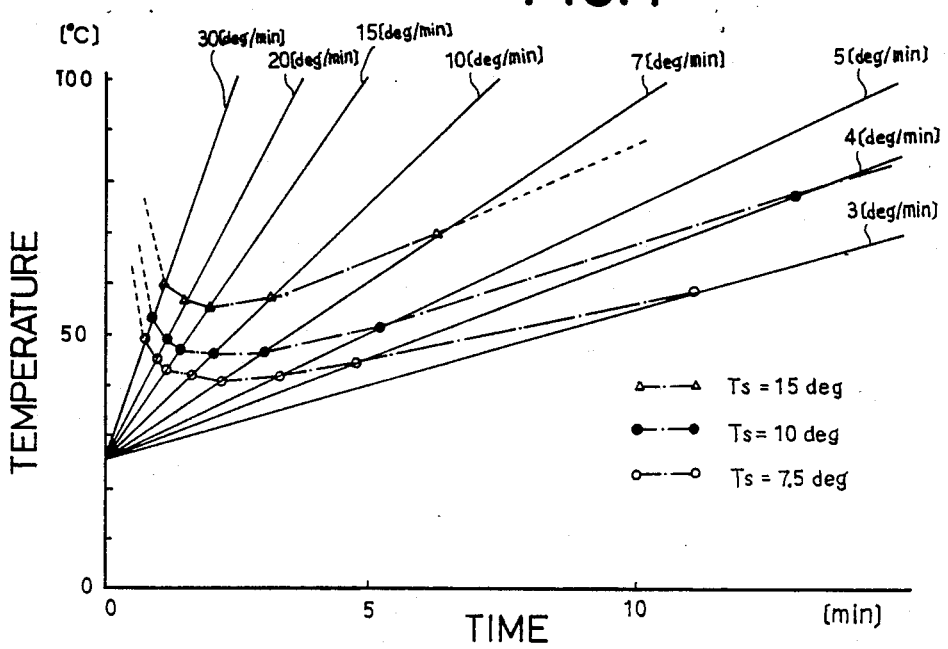
FIG. 4 is a graph showing the relation between the fire discriminating threshold value Ts and time required for fire discrimination which varies with the former using the rise rate of the detected temperature as a parameter.

FIG. 4 is a graph showing the relation between the threshold value Ts set in the fire discrimination unit 22 and the time required for the discrimination of fire.

More specifically, FIG. 4 shows the detected temperature rise characteristics having different temperature rise rate with the initial value of 25° C. so that if, for example, the threshold value Ts is set as Ts=10 degrees as shown in FIG. 3, a fire discriminating time characteristic given by the dot-and-dash line connecting the black circled points results with respect to the respective temperature rise straight lines. This fire discriminating time characteristic can be changed to have longer fire discriminating times as shown by the dot-and-dash line connecting the triangled points if, for example, the threshold value Ts is increased as Ts=15 degrees, while conversely it can be changed to have shorter fire discriminating times as shown by the dot-and-dash line connecting the circled points if the threshold value Ts is decreased as Ts=7.5 degrees.

Also, considering the characteristic given by the dot-and-dash line connecting the black circled points with the threshold value Ts=10 degrees in FIG. 4, the discrimination of a fire is made in about 1 minute and 20 seconds when the rise rate is 15 deg/min and therefore this fully satisfies the function of giving for example an alarm within 4.5 minutes as required for the conventional differential-type heat sensing apparatus. On the other hand, with the rise rate of 3 deg/min, there is no possibility of giving an alarm within 15 minutes and the function in this respect is also fully satisfied.

Figure 5:
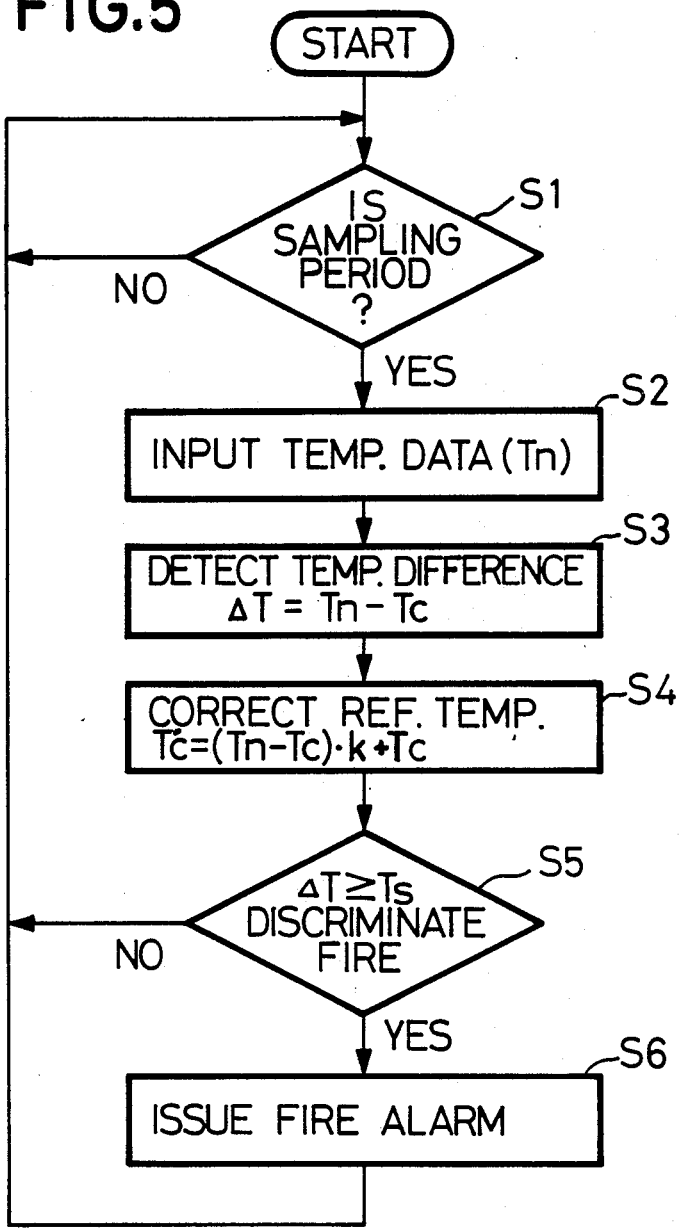
FIG. 5 is a flow chart showing the fire discrimination processing according the the embodiment of FIG. 1.

Referring now to FIG. 5, there is illustrated a flow chart showing the fire discriminating processing in the receiver 12.

In the flow chart of FIG. 5, at a step S1, the sampling period is monitored first so that if the sampling period of 5 seconds, for example, is reached, a transfer is made to a step S2 where the then current temperature data Tn is inputted. At a step S3, a reference temperature data Tc is subtracted from the detected temperature Tn to determine a temperature difference ΔT. Then, at a step S4, a correction value Ta is computed from the previously mentioned equation (1) and the reference temperature setting is updated by the correction value Ta. At a step S5, and threshold value Ts and the difference value ΔT are compared so that if the temperature difference ΔT is smaller than the threshold value Ts, a return is made to the step S1. On the contrary, if the temperature difference ΔT is greater than the threshold value Ts, the outbreak of a fire is determined so that a fire alarm is issued at a step S6 and a return is made to the step S1.

Figure 6:
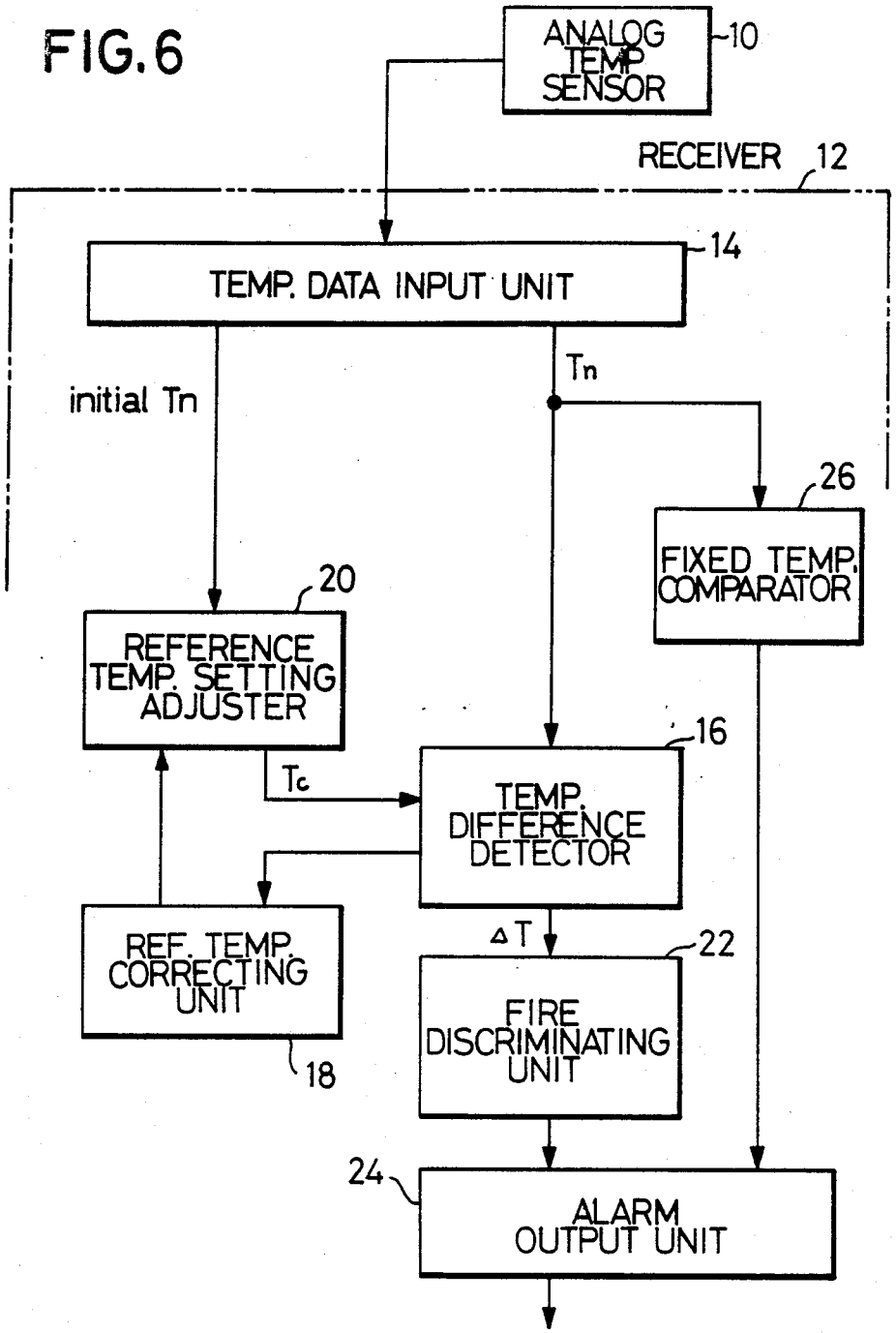
FIGS. 6 and 7 are block diagrams showing another embodiments of the invention.

Referring now to FIG. 6, there is illustrated a block diagram showing another embodiment of the invention and this embodiment features the addition of a fixed temperature-type fire discrimination to the differential-type fire discrimination incorporated in the embodiment of FIG. 1.

In other words, the analog temperature sensor 10 and the differential-type fire discriminating blocks provided in the receiver 12 are the same as the embodiment of FIG. 1 and a fixed temperature comparator 26 is newly added. The fixed temperature comparator 26 is supplied with the temperature data Tn obtained by the temperature data input unit 14 by sampling the input at a given sampling period and converting it to digital data. A threshold value of 60° C., for example, is set as a fixed temperature fire discrimination threshold value in the fixed temperature comparator 26 so that when the detected temperature Tn is greater than the threashold value 60° C., it is determined that there is the outbreak of a fire and an alarm command signal output is applied to the alarm output unit 24.

By thus providing the fixed temperature comparator 26, in contrast to the differential-type fire discrimination shown in FIG. 4, the fixed temperature comparator 26 functions effectively in the case of a fire.

Figure 7:
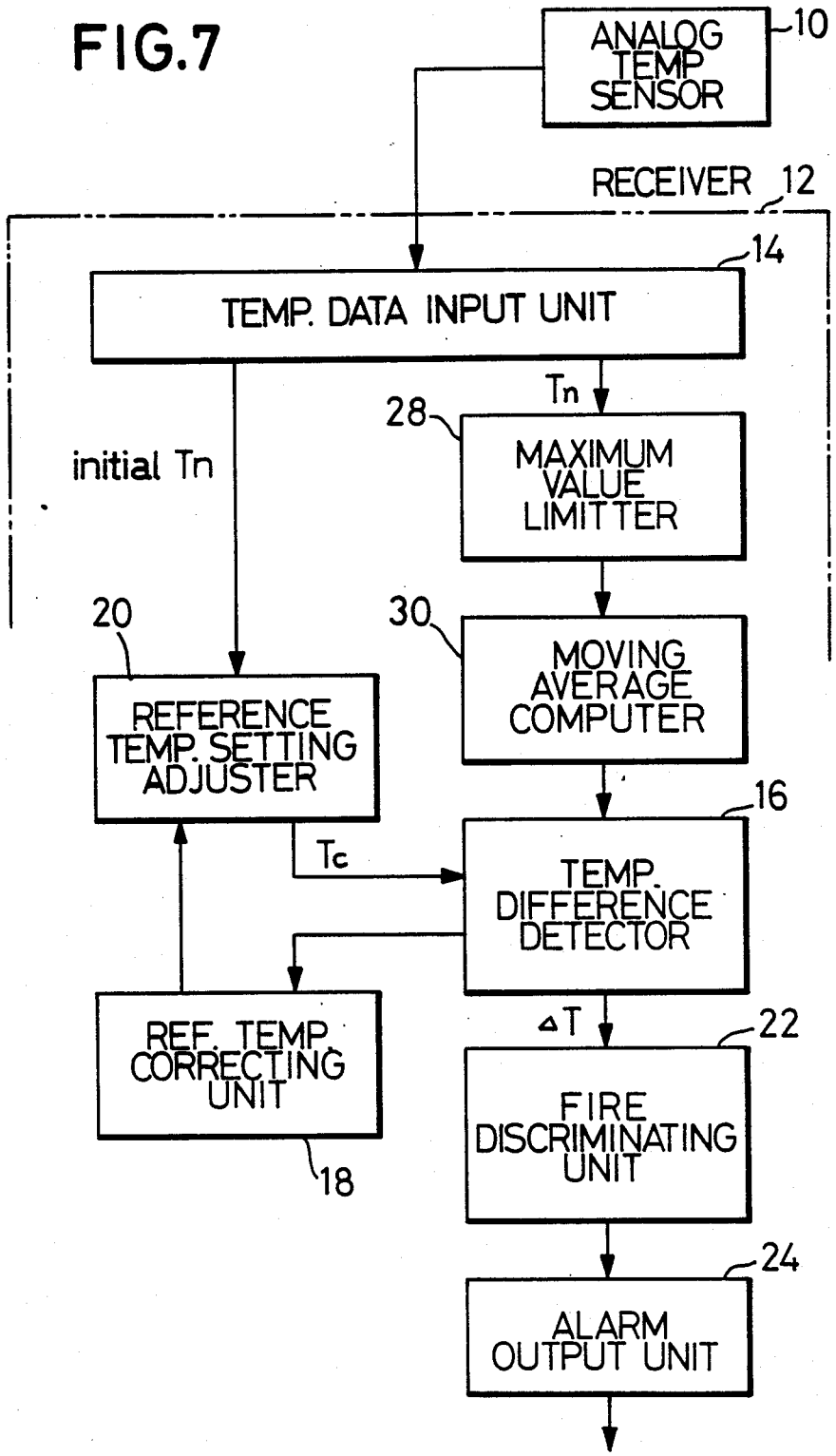

FIG. 7 shows a block diagram of still another embodiment of the invention, and this embodiment features that there is a limit to the maximum value of the rate of rise of temperature data used for the differential discrimination of a fire and also a moving average of the sample temperature data is produced.

In FIG. 7, the detection signal from the analog temperature sensor 10 is sampled at the given period and converted to digital temperature data which in turn is applied to a newly provided maximum value limiter 28. The maximum value limiter 28 limits the maximum value of the rate of change of the temperature data to 60 deg/min centrigrade, for example, so that if the sampling period of the temperature data input unit 14 is for example 5 seconds (1/12 min), the maximum value limiter 28 compares the detected temperature Tn by the current sampling and the detected temperature Tn-1 by the preceding sampling so that if there is a change of greater than 60/12=5 degrees, the current detected temperature Tn is not employed and instead the preceding detected temperature Tn-1 increased by 5 degrees (decreased when the temperature is decreased) is generated as detection temperature Tn. This function of the maximum value limiter 28 is due to the fact that when the maximum rate of change of the detected temperature is 60 deg/min centigrade, a change of 5 degrees within 5 seconds cannot be predicted as the change of the detected temperature from the analog temperature sensor 10 due to a fire phenomenon and therefore the maximum value limiter 28 is effective in the elimination of electrical noise.

The output of the maximum value limiter 28 is applied to a newly provided moving average computer 30. In the embodiment, the moving average computer 30 produces a moving average of the detected temperatures for the 5 sampling periods so that in this case it has a function of a filter which cuts off the frequency components higher than a cutoff frequency of 40 mHz and therefor it has a function of eliminating any temperature change due to electrical noise or the like without causing any effect on the temperature change due to a fire phenomenon. Specifically, a moving average of the 5 detected temperatures for the 5 periods preceding the current period is computed over the sampling periods and outputted.

The temperature difference detector 16, the reference temperature correcting unit 18, the reference temperature setting adjuster 20, the fire discriminating unit 22 and the alarm output unit 24, following the moving average computer 30, are the same in construction and function with those of the embodiment in FIG. 1.

Thus, in accordance with the embodiment of FIG. 7, by performing a preliminary processing on the sampled temperature data prior to the differential-type fire discrimination by the maximum value limiter 28 and the moving average computer 30, it is possible to positively eliminate electrical noise by any other cause than a fire, thereby greatly improving the reliability of the differential-type fire discrimination.

Of course, as in the case of the embodiment of FIG. 6, in the embodiment of FIG. 7 may be designed so that the fixed temperature comparator 26 is provided and the output data of the moving average computer 30 is used to perform the fire discrimination of the fixed temperature type.

While, in the above-described embodiment, the single analog temperature sensor 10 is connected to the receiver 12, a plurality of analog temperature sensors may be connected to the receiver 12 so that the detected temperatures from the temperature sensors are successively inputted by scanning or polling to effect the discrimination of a fire.

Further, the differential-type fire discriminating unit may be provided, along with the analog temperature sensor, in the sensing apparatus itself to send the output signal of the alarm output unit 24 to the receiver.

What is claimed is:

1. A fire discriminating apparatus comprising:

a temperature sensor for detecting a temperature in an area under surveillance to generate a detected temperature output signal proportional thereto;

sampling means for intermittently sampling said detected temperature data detected by said temperature sensor at a predetermined period;

temperature difference detecting means whereby each time said detected temperature data is sampled by said sampling means, an output corresponding to a temperature difference between said sampled detected temperature and a predetermined reference temperature is generated;

fire discriminating means whereby when said temperature difference is greater than a predetermined threshold value, the outbreak of a fire is determined and an alarm command signal is generated; and reference temperature correcting means whereby a correction value is produced by multiplying a value of said temperature difference obtained upon each said sampling by a predetermined factor smaller than 1 and said correction value is added to said reference temperature to correct the same for the purpose of temperature difference detection during the next sampling.

2. An apparatus according to claim 1, further comprising means for setting as said reference temperature a temperature in an area under surveillance detected by said temperature sensor during initialization of said apparatus.

3. An apparatus according to claim 1, further comprising temperature comparing means for generating another alarm command signal when said detected temperature detected by said temperature sensor reaches a predetermined upper limit temperature.

4. An apparatus according to claim 1, further comprising maximum value limiting means for establishing an upper limit to a rate of rise of said detected temperature value resulting from said sampling, and means for computing a moving average of detected temperatures resulting from said sampling over a plurality of sampling periods and passed through said maximum value limiting means, said maximum value limiting means and said moving average computing means being arranged between said sampling means and said temperature difference detecting means, whereby each time said sampling is effected, said temperature difference detecting means generates an output corresponding to a temperature difference between said moving average value of said detected temperatures and said reference temperature.

* * * * *